US011629041B2

(12) United States Patent
McCann

(10) Patent No.: US 11,629,041 B2
(45) Date of Patent: Apr. 18, 2023

(54) TAP LINE CLEANER AND BEVERAGE SAVING DEVICES, SYSTEMS, AND SOLUTIONS

(71) Applicant: Eric McCann, Stillwater, MN (US)

(72) Inventor: Eric McCann, Stillwater, MN (US)

( * ) Notice: Subject to any disclaimer, the term of this patent is extended or adjusted under 35 U.S.C. 154(b) by 0 days.

(21) Appl. No.: 17/138,011

(22) Filed: Dec. 30, 2020

(65) Prior Publication Data

US 2022/0204333 A1 Jun. 30, 2022

(51) Int. Cl.
*B67D 1/08* (2006.01)
*B67D 1/00* (2006.01)

(52) U.S. Cl.
CPC ..... *B67D 1/0837* (2013.01); *B67D 1/0887* (2013.01); *B67D 1/0888* (2013.01); *B67D 2001/0093* (2013.01); *B67D 2210/00002* (2013.01)

(58) Field of Classification Search
CPC ..... B67D 1/07; B67D 1/0837; B67D 1/0887; B67D 2001/075; B67D 2001/0093; B67D 2210/00002; A23G 9/30; A23G 9/305
See application file for complete search history.

(56) References Cited

U.S. PATENT DOCUMENTS 2,645,379 A * 7/1953 Audia ..... B67D 1/07 222/145.2
3,441,034 A * 4/1969 Burks ..... B67D 1/07 134/169 C
4,527,585 A * 7/1985 Mirabile ..... B08B 9/0323 134/166 C
5,762,096 A * 6/1998 Mirabile ..... B08B 9/0325 134/100.1
6,486,453 B1 * 11/2002 Bales ..... H05B 6/6435 219/400
2006/0175352 A1 * 8/2006 Emmendorfer ..... B08B 9/0325 222/148
2007/0193653 A1 * 8/2007 Gagliano ..... B67D 1/0855 141/256
2008/0189078 A1 * 8/2008 Vok ..... B67D 1/0831 702/188
2008/0223410 A1 * 9/2008 Molloy ..... B08B 9/0325 134/22.11
2010/0176147 A1 * 7/2010 Segers ..... B67D 1/0834 222/1
2011/0070344 A1 * 3/2011 Johnson ..... A23L 3/358 426/238

(Continued)

*Primary Examiner* — Jason K Niesz
(74) *Attorney, Agent, or Firm* — Brooks, Cameron & Huebsch, PLLC

(57) ABSTRACT

Devices, systems, and solutions for cleaning tap lines are described herein. One tap line cleaning system, includes a beverage dispensing tap, a beverage storage container, a tap line allowing fluid communication of a beverage between the beverage storage container connected at a first end of the tap line and the beverage dispensing tap connected at a second end of the tap line, a cleaning solution reservoir, a cleaning solution line allowing fluid communication of a cleaning solution into the first end of the tap line such that the cleaning solution can pass into the first end of the tap line, out of the second end of the tap line and exit the system via the beverage dispensing tap, and a valve to switch a valve position between closed and open to allow fluid communication of the cleaning solution to the tap line.

20 Claims, 1 Drawing Sheet

(56) References Cited

U.S. PATENT DOCUMENTS

| | | | | |
|---|---|---|---|---|
| 2012/0048888 | A1* | 3/2012 | Pizzacella | F16K 31/30 222/144.5 |
| 2014/0166053 | A1* | 6/2014 | Carson | B08B 9/0321 134/22.11 |
| 2016/0355389 | A1* | 12/2016 | Bursey | B67D 1/0884 |
| 2017/0057805 | A1* | 3/2017 | Bischel | A23G 9/228 |
| 2019/0030197 | A1* | 1/2019 | Johnson | A61L 2/24 |
| 2019/0073800 | A1* | 3/2019 | Lochny | H04L 12/282 |
| 2020/0247657 | A1* | 8/2020 | Christiansen | B67D 1/0837 |

* cited by examiner

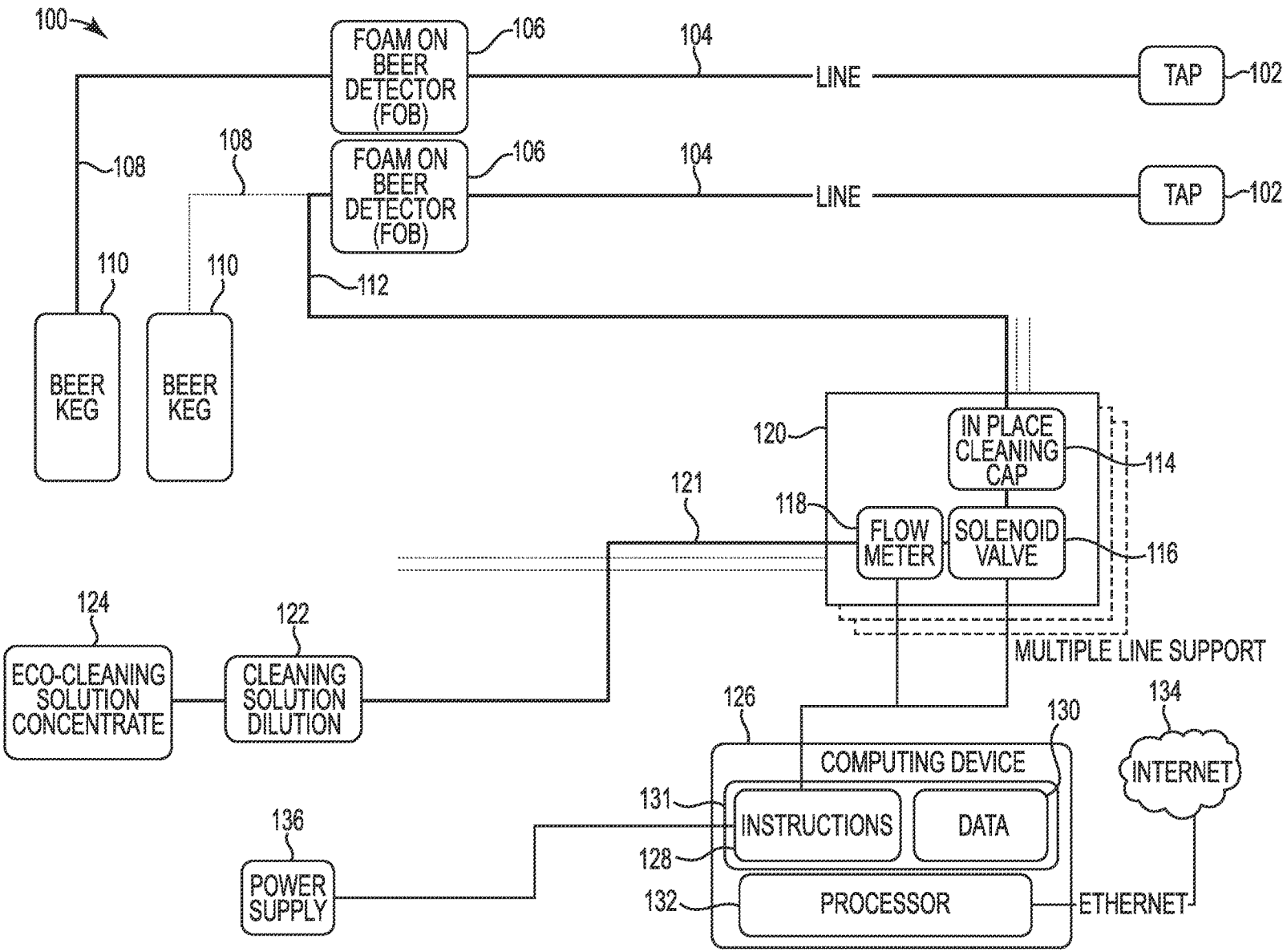
100
TAP
102
TAP
102
LINE
104
LINE
104
FOAM ON BEER DETECTOR (FOB)
106
FOAM ON BEER DETECTOR (FOB)
106
108
108
BEER KEG
110
BEER KEG
110
112
IN PLACE CLEANING CAP
114
SOLENOID VALVE
116
FLOW METER
118
120
121
MULTIPLE LINE SUPPORT
CLEANING SOLUTION DILUTION
122
ECO-CLEANING SOLUTION CONCENTRATE
124
COMPUTING DEVICE
126
DATA
128
INSTRUCTIONS
130
PROCESSOR
131
132
INTERNET
134
ETHERNET
POWER SUPPLY
136

TAP LINE CLEANER AND BEVERAGE SAVING DEVICES, SYSTEMS, AND SOLUTIONS

TECHNICAL FIELD

The present disclosure relates generally to tap line cleaner devices, systems, and solutions, such as cleaning beer tap lines at drinking establishments and restaurants.

BACKGROUND

Taps for serving beverages are used in many drinking and restaurant establishments where a large volume of a beverage is served to patrons. This is advantageous as the taps can be mounted in a service area, such as on the top of a bar or in a wall of a restaurant and the storage of the beverage can be maintained in a storage area out of sight of the patrons.

This allows the beverage to be stored in large containers, such as kegs, and then smaller amounts can be dispensed to patrons via tubes (called tap lines) connected between the large storage container and the tap. This also allows for the beverage to be kept in a cool area, so it can be served cold, whereas keeping such a large quantity of the beverage cool and stored behind a bar or within the dining area of a restaurant may be difficult and unsightly to the patrons.

There are many benefits to such a system. However, one issue that arises is that these lines are full, from end to end, with the beverage and after a period of time, the lines will need to be cleaned.

The current state of the art process of cleaning is to shut down the line (i.e., no beverage can be dispensed to patrons). This results in unavailability of that particular type of beverage until the line is brought back into service.

The beverage is then drained from the line. This drained quantity of beverage is disposed of which is a monetary cost for the establishment serving the beverage.

A toxic solution is then run through the line to clean the interior of the line. The line is then rinsed to remove the majority of the toxic solution as it is not suitable to be served to patrons. The line is then refilled with the beverage. However, as some toxic solution may have mixed with the beverage, a certain amount of the drink the first comes out must also be discarded to ensure patrons do not ingest the toxic solution.

For establishments with many lines distributing many types of beverage, this process can be cumbersome, as each line needs to be shut down and cleaned resulting in significant downtime, wage time for the cleaners, and loss of beverage due to the necessary disposal.

BRIEF DESCRIPTION OF THE DRAWINGS

FIG. 1 is an illustration of a tap cleaning system in accordance with an embodiment of the present disclosure.

DETAILED DESCRIPTION

The present disclosure relates generally to tap line cleaner devices, systems, and solutions. Specifically, the present disclosure relates to devices and systems for cleaning a tap line more quickly and with less waste and non-toxic cleaning solutions for cleaning tap lines.

One tap line cleaning system, for example, includes a beverage dispensing tap, a beverage storage container, a tap line allowing fluid communication of a beverage between the beverage storage container connected at a first end of the tap line and the beverage dispensing tap connected at a second end of the tap line, a cleaning solution reservoir, a cleaning solution line allowing fluid communication of a cleaning solution into the first end of the tap line such that the cleaning solution can pass into the first end of the tap line, out of the second end of the tap line and exit the system via the beverage dispensing tap, and a mechanism to switch a valve to switch a valve position between closed and open to allow fluid communication of the cleaning solution to the tap line. Discussed herein are more embodiments of the present disclosure that provide novel advantages over the prior art.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

As used herein, "a", "an", or "a number of" something can refer to one or more such things, while "a plurality of" something can refer to more than one such things. For example, "a number of components" can refer to one or more components, while "a plurality of components" can refer to more than one component.

Prior processes were time consuming and costly to the establishment. For example, in many cleaning processes, the cleaning technicians enter an establishment at a designated cleaning time and create a loop between the front (where the tap is attached) and the back where the beverage storage container is attached). This occurs by removing a coupler attached to the beverage storage container and attaching the coupler to the cleaning solution line that will provide cleaning solution to the tap line.

On the tap end, they remove the tap and attach the cleaning line (to form the loop). Also attached in the loop is a pump that moves the beverage or the cleaning solution through the lines and a drain that allows removal of the beverage or cleaning solution out of the loop. Once the loop is created, the beverage in the tap line is removed as cleaning solution is added to the tap line. This beverage is wasted. The tap line is then filled with the cleaning solution.

The cleaning solution is then cycled through the loop for a predetermined time (e.g., 15 minutes). The cleaning solution is then removed and the line is rinsed and the tap line is tested to make sure none of the toxic solution is present in the tap line. The tap line is then refilled with beverage and the tap line is clear for dispensing of beverage.

Rather than having to schedule a time for the cleaning technicians to visit the establishment, a cleaning system or device embodiment of the present disclosure can be installed at the establishment and then the establishment can do this cleaning of tap lines on their own schedule and there is no need for specialized technicians to enter the establishment to clean the tap lines.

The embodiments of the present disclosure can also include other monitoring functions. For example, system embodiments can include: temperature monitoring of storage cooler and/or one or more products in the cooler, inventory and product (e.g., beverages and/or associated items, cleaning solution, other products available at the establishment) usage monitoring, beverage gas (e.g., carbon dioxide, nitrogen, etc. used with the beverage), airflow monitoring, and/or glycol chiller fluid temperature and/or efficacy monitoring. These functions can be provided by the controller discussed herein or could be integrated into an existing the point of sale and/or inventory management system at the establishment, with communication to/from sensors and/or user inputs via a user input interface.

For instance, sensors can be positioned in one or more places within the storage cooler, glycol chiller, and/or on product (e.g., beverage or other products) containers to monitor the temperature and/or airflow. The system can, then, report the sensed temperature/airflow data to the controller to be utilized by the controller to alert users of the system to the status of the cooler and/or products therein and/or issues related to their temperature and/or airflow.

In another example, gas can be managed by entering through the user input interface, a quantity of beverage gas available to be used and the user can input the decrease of available gas. The controller can then alert the user when the gas is below a threshold amount and may even open a display screen to facilitate reordering of the gas before the establishment runs out of the gas.

FIG. 1 is an illustration of a tap cleaning system in accordance with an embodiment of the present disclosure. As illustrated in FIG. 1, the system 100 can be installed attached to a typical tap, tap line, beverage container setup. In the embodiment shown, the establishment has two tap lines 104 each attached to a tap 102 and a beverage storage container 110 (e.g., a beer keg). In the setup shown, each tap line is connected to a foam on beer (FOB) detector 106 with a second portion of the tap line 108 connected between the FOB 106 and the beverage storage container 110.

In the embodiment shown, a cleaning cap 114 is a connector (e.g., can be mounted as a wall installation in the storage area) that allows connection of the second tap line portion 108 to the cleaning solution system, as discussed above. In this manner, one of the tap lines 108 is disconnected from the beverage storage container (e.g., keg) 110 and tap line portion 108 is attached to cleaning cap 114 creating a cleaning solution line 112 that is attached to allow cleaning solution, instead of the beverage, to flow through the FOB and tap line 104 to clean the tap line and tap 102 that are in fluid communication with the cleaning solution line 112.

As discussed herein, the cleaning system includes a cleaning device which is a computing device 126 with tap line cleaning controller functionality including a processor 132 and memory 131 that has instructions 128, executable by the processor to perform functions described herein, and data 130 to be used in the execution of the functions described. The cleaning system also includes a power supply for providing power to the cleaning device and to one or more flow meters 118 and solenoid valves 116 or other electrical components of the system. In some embodiments, the cleaning device can also have a network connection 134 for connection to one or more networks.

The system also includes a cleaning solution storage container (reservoir). In the example of FIG. 1, the system include a storage container for the concentrated cleaning solution 124 and a container 122 for solution that has been diluted by water. This diluted mixture container is connected to the flow meter 118 by an extension to the cleaning solution line 121.

The system can also be expanded by adding additional units 120 such that the system has multiple flow meters, solenoid valves, and cleaning solution lines, allowing multiple tap lines to be cleaned simultaneously. The features and functions of the above items will be described in more detail herein.

Embodiments of the present disclosure the cleaning device can alert the establishment employees that it is time for the line to be cleaned. In various embodiments, this time schedule can be established by the establishment or the cleaning system provider and can, for example, be according to a government mandated safety schedule, according to industry established best practices, establishment preferences, and/or cleaning system provider guidelines.

Such schedules, dates, or times between cleanings can be stored in memory and referenced by computing device executable instructions that can display the information to the cleaning system's users (e.g., establishment's employees) and/or provide an alert (e.g., visual and/or audible alert). In some embodiments, the timing can be programmable by the establishment or the cleaning system provider and can be changed to suit the establishment, cleaning system provider, and/or government safety entity.

For example, systems may be installed in different states in which the government safety requirements may be different and, so the different systems to be installed can be modified to accommodate the different government requirements. In another implementation, one establishment may want to clean the tap line every two weeks, another twice monthly, another every two months, another may track the amount of beverage through the tap line and change after a certain volume has passed through, and still another with no set schedule (presumably every time the beverage storage container is changed out).

In some such embodiments, the system could be programmable to accommodate such schedules. This may, for example, be programmed by the cleaning system provider or, in some embodiments, a display associated with the computing device may include a selection screen where a user may select the schedule type to be used. Accordingly, in some such embodiments, the computing device will have a timing circuit and/or may be connected to a network that has a time indicator (e.g., an Internet available timing resource).

In some embodiments, the process of cleaning the tap lines includes the user at the establishment going into the area where the beverage storage containers are stored, disconnecting the end of the tap line connected to the beverage storage container, connecting that end to the cleaning system. In some embodiments, in establishments that have multiple tap line dispensing different types of beverages (e.g., parallel lines each connected to a different beverage storage container and a different tap) the cleaning system/device can indicate (e.g., via an audible or visual signal) which tap line(s) is to be cleaned.

For example, the display can indicate that tap line #6 needs cleaning. The display can, for example, present the following dialogue to the user:

Tap line 6 is scheduled for cleaning at this time.

Would you like to clean tap line 6 now? Yes/No

The user can then make the selection and initiate the cleaning process. Once initiated, the system/device activates the flow of the cleaning solution into the tap line and a flow meter can be used to determine the amount of cleaning solution that has flowed past the meter and into the tap line.

Unlike prior cleaning processes, preliminary testing indicates that since the tap line in the proposed process is still full of beverage, the flow of the cleaning solution is controlled by the dispensation of beverage from the tap. In other words, since the end of the beverage in the tap line abuts the beginning of the cleaning solution, there is nowhere for the cleaning solution to flow to within the tap line.

And, as such, as beverage is dispensed out of the tap, the end of the remaining beverage moves closer to the tap as does the beginning of the cleaning solution. In this manner, the remaining beverage is slowly replaced by cleaning solution within the tap line as the beverage is dispensed.

The tap line can be of any length. A short line can have, for example, six ounces of beverage or less in it or sixteen pints or more in a longer line.

The length of the tap line can be measured or estimated and this information can be used to determine when the cleaning solution has nearly filled the tap line. For example, when the cleaning system or tap line is installed, the tap line length and internal diameter can be measured and this information or calculations based on these measurements (e.g., fluid volume within a particular length of the tap line) can be stored in memory of the cleaning system/device. Based on the interior diameter of the tap line, an amount of fluid within the tap line can be determined.

The flow meter can track the amount of beverage dispensed since the cleaning solution was introduced. The flow meter amount and the calculated amount of fluid within the tap line can be compared. And, when the flow meter amount nears the amount of fluid within the tap line, an audible or visual alert can be provided to the user, via the computing device, to alert the user that the tap will soon dispense the cleaning solution and, therefore, they should no longer dispense beverage to patrons. It should be noted that the alerts discussed herein can include text alerts to employees that can be sent via a connection to the Internet or other network.

Additionally or alternatively, in various embodiments, the computing device can instruct the solenoid valve to close, thereby not allowing any more fluid to move through the tap line once the tracked amount of beverage or cleaning solution (depending on what part of the cleaning process is being accomplished) reaches a certain predetermined volume, for example, set by the user when the length and diameter of the tap line is measured, among other times for setting or through use of other calculation methods.

This mechanism can be utilized during one or both of the introduction of the cleaning solution to the tap line or during the removal of the cleaning solution from the tap line. The calculation used in the tracking can be the same as described above.

In some embodiments, the cleaning system/device can include a setting to alert the user that a defined time period for dispensing the beverage has passed and that they should dispose of the remaining beverage in the tap line. For example, this may be set at three days and after that point, the establishment should sell the beverage as a special or at a discount to remove the beverage from the tap line. As with timing between cleanings, some embodiments, can allow this timing to be set or changed and stored in memory.

Once the cleaning solution is near the tap end of the tap line, the connector near the cleaning solution storage container end can be switched to the beverage storage container and the beverage can begin to flow into the tap line behind the cleaning solution.

In some embodiments, the system/device can include a prompt for the user to indicate that the cleaning process has been completed. This can, for example, be used to reset cleaning timeframes, among other uses.

The cleaning solution in the tap line can then be run out of the tap (with the beverage advancing through the tap line behind it). If a non-toxic cleaning solution, such as that disclosed herein is used, then once the user sees beverage pouring out of the tap, the user can begin dispensing the beverage to patrons again.

Through use of embodiments of the present disclosure, there is very little mixing at the abutting between the beverage and the eco-friendly, non-toxic cleaning solution proposed herein. This is because there is little to no air gap between the fluids and when they move, they move together like a single fluid.

Also, the chemical composition of the cleaning solution disclosed herein does not mix readily with a beverage, such as beer, allowing the two fluids to travel through the tap line without mixing. The effect could be viewed as similar to that of a Black and Tan beer-based drink where the stout does not readily mix with the pale ale.

The system can be integrated with the point of sale and/or inventory management system (e.g., beverage and/or food tracking) used by the establishment. For example, the items discussed herein as being shown on a display can be shown on the display that is part of the point of sale and/or the inventory management system. The computing device could also be the same device that hosts the point of sale and/or the inventory management system, in some embodiments.

In various embodiments, the computing device can be located in the beverage container storage location (e.g., a cooler or storage room) and can include, for example, a processor, memory, display (e.g., a touch screen to allow user input), a user input interface if a touch screen is not used, a power supply, a valve (e.g., solenoid valve) for switching between beverage dispensing and cleaning, and a flow meter.

In some embodiments, some components may be in different areas on the establishment. For example, some components may be near the taps and others may be in the storage area. In another example, the display or other temperature sensitive components may be positioned outside of a cooled space, for example, in implementations where the cooled environment may interfere with the functioning of a touch screen.

In systems that are utilized with, for example, up to six tap lines, one such device can be used. For use with larger setups multiple devices can be used or, alternatively, additional flow meters and/or valves can be connected to the device to create a larger system that can handle more tap lines. In some embodiments, each tap line can have its own flow meter and/or valve.

In some embodiments, as indicated above, a solenoid valve can be utilized. In such embodiments, the solenoid can be actuated by the computing device during a switch between the connection to the beverage storage container and the cleaning solution container.

In some embodiments the system can be portable. This can allow the system to be transported and connected the tap lines at other establishments. For example, an enclosure could be placed around the processor, memory, display, user input interface, power supply, valve for switching between beverage dispensing and cleaning, and a flow meter and this system could then be moved around an establishment or taken from one establishment to another.

In some embodiments, the system can include multiple screens. For example, a screen can be provided near the taps that can provide status information about the status of each tap line. In some embodiments, this can be a text status and in other embodiments it could include color coded (or other ID type) status indicators such as green—for operational (e.g., cleaned within a predetermined time period, such as the last two weeks), yellow—within a threshold timeframe from a scheduled cleaning time (e.g., two days from the two week date), red—for in need of cleaning (e.g., beyond two weeks from last cleaning), and blue being cleaned presently. Other information could, for example, include tap line ID (e.g., TL1), beverage being dispensed (e.g., Bass Ale). A second display could be located in the back and could have similar information presented thereon but could also include a user input component to all the user to update information within the system as beverages are changed and cleaning processes are finished. The user input component could also be that of a point of sale system or inventory management system, in some embodiments, and could be located elsewhere in the establishment.

In some embodiments, the display and user input can confirm the cleaning process is to be started on a particular tap line (e.g., user can touch the displayed tap line on the touch screen). Some embodiments can provide instructions (step-by-step pictures or video) on how to administer the cleaning process. These instructional aids can be stored in memory or accessed via the network connection.

Some systems include a foam on beer (FOB) detector component along the tap line. The FOB detector detects when foam may be present in the tap line and provides a reservoir for catching some of the foam before it reaches the tap. These components can also be cleaned using a system as disclosed herein as the FOB component is in-line with the tap line, as shown in FIG. 1 and the cleaning solution will also pass through the FOB component on its way to the tap.

With respect to the novel, non-toxic cleaning solution and its storage and use, the solution is a combination of a catholyte and an anolyte. They can be premixed and stored in the storage area where the beverage is stored or elsewhere in the establishment.

The prior art recommendation is that tap lines are to be cleaned with a hot, toxic solution, however, tests on the solution disclosed herein indicate that it cleans satisfactorily at any temperature and cleans at least as well as the toxic solution. Being that the solution disclosed herein can be used at any temperature, this allows the solution to be stored in other areas and provides for less preparation of the solution before introduction into the tap line, among other benefits.

The catholyte and anolyte could also be stored in separate containers and mixed prior to being dispensed into the tap line. The solution can also be diluted with water and this can, for example, be done prior to the mixture entering the tap line, as shown in FIG. 1. The mixture, including the water, can also be premixed and stored.

In some embodiments, the solution can be premixed and stored in, for example, a keg or mini-keg that can be pressurized to allow for the solution to be pushed out of the keg and into the tap line. In this manner, the solution can be very portable and allow for ease of use as it does not need to be mixed at the establishment and can easily be moved from one establishment to another.

The system can also be configured to track the usage of the cleaning solution and, in this way, can indicate when new solution needs to be ordered. Through use of the portable containers, establishments can easily order more when the system indicates more solution is needed, which can minimize storage needed for the cleaning solution, among other benefits.

With regard to the composition of the solution, the solution can be comprised of 40-60% catholyte and 60-40% anolyte. It is, however, preferred that the percentage weight of catholyte is greater than or equal to the anolyte, in some implementations. The preferred concentration is 50%/50%. This appears to be because the catholyte carries an alkalinity that is beneficial in the cleaning process, but the sanitizing and bacteria killing abilities of the anolyte are also important and so a balance of the two is beneficial.

This solution (catholyte/anolyte) can then be mixed at a 10-25% concentration to 90-75% water. In some embodiments, the percentage of solution could be higher than 25%. A preferred concentration is 19%-25% solution to 81%-75% water. In embodiments where the solution and water are not premixed, a second solenoid valve could be used to vary the mixture percentages of the solution and water mixture.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A tap line cleaning system, comprising:

a beverage dispensing tap;

a beverage storage container;

a tap line allowing fluid communication of a beverage between the beverage storage container connected to the tap line and the beverage dispensing tap connected to the tap line;

a cleaning solution line allowing fluid communication of a cleaning solution into the tap line such that the cleaning solution can pass into the tap line and exit the tap line via the beverage dispensing tap;

a valve, actuated by a computing device, to switch a valve position between a beverage dispensing position and a cleaning solution position and wherein the cleaning solution position allows fluid communication of the cleaning solution to the tap line, the computing device including executable instructions that actuate the valve such that, when the cleaning solution is introduced to the tap line, an end of the beverage in the tap line abuts a beginning of the cleaning solution and the cleaning solution travels behind the beverage through the tap line as the beverage is dispensed; and the valve, also actuated by the computing device, to switch a valve position between the cleaning solution position and the beverage dispensing position to stop fluid communication of the cleaning solution to the tap line, the computing device including executable instructions that actuate the valve such that, when the beverage is reintroduced to the tap line, an end of the cleaning solution in the tap line abuts a beginning of the beverage and the beverage travels behind the cleaning solution through the tap line until the beverage emerges from the tap and is dispensed.

2. The tap line cleaning system of claim 1, wherein the system further includes a flow meter, that tracks an amount of beverage or cleaning solution that passes through the flow meter, and a tap line cleaning controller, wherein the tap line cleaning controller instructs the valve to close, thereby not allowing any more fluid to move through the tap line once the tracked amount of beverage or cleaning solution has flowed through the flow meter.

3. The tap line cleaning system of claim 1, wherein the system further includes a tap line cleaning controller having a processor and memory, and wherein the tap line cleaning controller sends an instruction that initiates the valve to switch a valve position between closed and open to allow fluid communication of the cleaning solution to the tap line.

4. The tap line cleaning system of claim 1, wherein the tap line includes a foam on beer detector that will also be cleaned via a flow of cleaning solution through the tap line.

5. The tap line cleaning system of claim 1, wherein the computing device displays a status of the tap line.

6. The tap line cleaning system of claim 1, wherein the computing device displays a request for a user to initiate cleaning.

7. The tap line cleaning system of claim 1, wherein the computing device displays a status of the tap line, wherein the status is selected from the group including: cleaned within a predetermined time period, within a threshold timeframe from a scheduled cleaning time, in need of cleaning, and being cleaned presently.

8. The tap line cleaning system of claim 1, wherein the system includes a cleaning solution reservoir and wherein the cleaning system reservoir includes a non-toxic cleaning solution.

9. The tap line cleaning system of claim 1, wherein the system includes a cleaning solution reservoir and wherein the cleaning system reservoir includes a cleaning solution consisting of a catholyte and an anolyte, wherein the catholyte is from 40-60 weight percent of the composition based upon a total weight of a combination of the catholyte and the anolyte.

10. The tap line cleaning system of claim 1, wherein the valve includes a solenoid that is electrically actuated to switch a valve position between closed and open to allow fluid communication of the cleaning solution to the tap line.

11. The tap line cleaning system of claim 10, wherein the solenoid is controlled by a tap line cleaning controller having a processor and memory, and wherein the tap line cleaning controller sends an instruction that initiates the valve to switch a valve position between closed and open to allow fluid communication of the cleaning solution to the tap line.

12. The tap line cleaning system of claim 1, wherein the tap line cleaning system includes a display that shows the status of the tap line, and wherein the status is selected from the group including: operational, within a threshold timeframe from a scheduled cleaning time, in need of cleaning, and being cleaned presently.

13. The tap line cleaning system of claim 12, wherein the display provides at least one of: a last time the tap line was cleaned and a time until the tap line is to be cleaned.

14. The tap line cleaning system of claim 12, wherein the system automatically updates the status of the tap line on the display once a tap line cleaning process has finished.

15. A tap line cleaning system, comprising:

a tap line allowing fluid communication of a beverage between a beverage storage container connected to the tap line and a beverage dispensing tap connected to the tap line;

a cleaning solution line allowing fluid communication of an amount of cleaning solution into a first end of the tap line such that the cleaning solution can pass into the first end of the tap line, out of a second end of the tap line and exit the system via the beverage dispensing tap; and a valve, actuated by a computing device, that switches a valve position between a beverage dispensing position and a cleaning solution position and wherein the cleaning solution position allows fluid communication of the cleaning solution to the tap line, the computing device including executable instructions that actuate the valve such that when the cleaning solution is introduced to the tap line an end of the beverage in the tap line abuts a beginning of the cleaning solution and the cleaning solution travels behind the beverage through the tap line as the beverage is dispensed;

the valve, also actuated by the computing device, to switch a valve position between the cleaning solution position and the beverage dispensing position to stop fluid communication of the cleaning solution to the tap line, the computing device including executable instructions that actuate the valve such that, when the beverage is reintroduced to the tap line, an end of the cleaning solution in the tap line abuts a beginning of the beverage and the beverage travels behind the cleaning solution through the tap line until the beverage emerges from the tap and is dispensed; and a flow meter that determines an amount of cleaning solution that has flowed into the tap line.

16. A tap line cleaning system, comprising:

a beverage dispensing tap;

a beverage storage container;

a tap line allowing fluid communication of a beverage between the beverage storage container and the beverage dispensing tap;

a cleaning solution reservoir having an amount of cleaning solution therein;

a cleaning solution line allowing fluid communication of at least some of the cleaning solution into the tap line such that the cleaning solution can pass into the tap line and exit the tap line via the beverage dispensing tap;

a valve, actuated by a computing device, to switch a valve position between a beverage dispensing position and a cleaning solution position and wherein the cleaning solution position allows fluid communication of the cleaning solution from the cleaning solution reservoir to the tap line, the computing device including executable instructions that actuate the valve such that when the cleaning solution is introduced to the tap line an end of the beverage in the tap line abuts a beginning of the cleaning solution and the cleaning solution travels behind the beverage through the tap line as the beverage is dispensed; and the valve, also actuated by the computing device, to switch a valve position between the cleaning solution position and the beverage dispensing position to stop fluid communication of the cleaning solution to the tap line, the computing device including executable instructions that actuate the valve such that, when the beverage is reintroduced to the tap line, an end of the cleaning solution in the tap line abuts a beginning of the beverage and the beverage travels behind the cleaning solution through the tap line until the beverage emerges from the tap and is dispensed.

17. The tap line cleaning system of claim 16, wherein the cleaning solution includes a catholyte and an anolyte and wherein the weight percent of the anolyte is less than the weight percent of the catholyte.

18. The tap line cleaning system of claim 16, wherein the cleaning solution includes a catholyte and an anolyte and wherein the cleaning solution further includes water making the weight percent of the catholyte and anolyte combination at least 20 weight percent of the total weight of the combination of the catholyte, the anolyte, and the water.

19. The tap line cleaning system of claim 16, wherein the cleaning solution includes a catholyte and an anolyte and the weight percent of the anolyte is less than the weight percent of the catholyte.

20. The tap line cleaning system of claim 16, wherein the cleaning solution includes a catholyte and an anolyte and the weight percent of the catholyte is less than the weight percent of the anolyte.

* * * * *